US011763836B2

(12) United States Patent
Tao et al.

(10) Patent No.: US 11,763,836 B2
(45) Date of Patent: Sep. 19, 2023

(54) HIERARCHICAL GENERATED AUDIO DETECTION SYSTEM

(71) Applicant: INSTITUTE OF AUTOMATION, CHINESE ACADEMY OF SCIENCES, Beijing (CN)

(72) Inventors: Jianhua Tao, Beijing (CN); Zhengkun Tian, Beijing (CN); Jiangyan Yi, Beijing (CN)

(73) Assignee: INSTITUTE OF AUTOMATION, CHINESE ACADEMY OF SCIENCES, Beijing (CN)

( * ) Notice: Subject to any disclaimer, the term of this patent is extended or adjusted under 35 U.S.C. 154(b) by 22 days.

(21) Appl. No.: 17/674,086

(22) Filed: Feb. 17, 2022

(65) Prior Publication Data

US 2023/0027645 A1 Jan. 26, 2023

(30) Foreign Application Priority Data

Jul. 21, 2021 (CN) ..... 202110827718.8

(51) Int. Cl.
*G10L 25/24* (2013.01)
*G10L 25/30* (2013.01)

(52) U.S. Cl.
CPC ..... *G10L 25/24* (2013.01); *G10L 25/30* (2013.01)

(58) Field of Classification Search
CPC ..... G10L 25/24; G10L 25/30
See application file for complete search history.

(56) References Cited

U.S. PATENT DOCUMENTS 6,253,178 B1* 6/2001 Robillard et al. ..... G10L 15/08 704/238
2003/0236661 A1* 12/2003 Burges et al. ..... G06K 9/6232 704/205
2005/0038649 A1* 2/2005 Billa et al. ..... G10L 15/28 704/231

(Continued)

FOREIGN PATENT DOCUMENTS

CN 109147799 A 1/2019
CN 110223676 A 9/2019

(Continued)

OTHER PUBLICATIONS

Bao et al., Research on Audio Spoofing and Audio Spoofing Detection, Information Technology and Standardization, Pages 54-58, Vol. 1-3, dated Mar. 10, 2020.

(Continued)

*Primary Examiner* — Fariba Sirjani
(74) *Attorney, Agent, or Firm* — Westbridge IP LLC

(57) ABSTRACT

Disclosed is a hierarchical generated audio detection system, comprising an audio preprocessing module, a CQCC feature extraction module, a LFCC feature extraction module, a first-stage lightweight coarse-level detection model and a second-stage fine-level deep identification model; the audio preprocessing module preprocesses collected audio or video data to obtain an audio clip with a length not exceeding the limit; inputting the audio clip into CQCC feature extraction module and LFCC feature extraction module respectively to obtain CQCC feature and LFCC feature; inputting CQCC feature or LFCC feature into the first-stage lightweight coarse-level detection model for first-stage screening to screen out the first-stage real audio and the first-stage generated audio; inputting the CQCC feature or LFCC feature of the first-stage generated audio into the second-stage fine-level deep identification model to identify the second-stage real audio and the second-stage generated audio, and the second-stage generated audio is identified as generated audio.

5 Claims, 1 Drawing Sheet

(56) References Cited

U.S. PATENT DOCUMENTS

| | | | | |
|---|---|---|---|---|
| 2006/0248019 | A1 | 11/2006 | Rajakumar | |
| 2010/0131273 | A1 | 5/2010 | Aley-Raz et al. | |
| 2010/0223056 | A1* | 9/2010 | Kadirkamanathan .. | G10L 13/08 704/E15.005 |
| 2013/0138439 | A1* | 5/2013 | Marcus et al. ..... | G10L 15/22 704/E15.001 |
| 2018/0254046 | A1* | 9/2018 | Khoury et al. ..... | G10L 25/24 |
| 2019/0103005 | A1* | 4/2019 | Gilberton et al. .. | G10L 21/0224 |
| 2020/0321008 | A1* | 10/2020 | Wang et al. ..... | G06N 3/0445 |
| 2020/0388295 | A1* | 12/2020 | Angland ..... | G10L 21/013 |
| 2021/0049346 | A1* | 2/2021 | Skala et al. ..... | G06V 20/698 |
| 2021/0073465 | A1* | 3/2021 | Duong et al. ..... | G10L 13/00 |
| 2021/0082438 | A1* | 3/2021 | Zhao et al. ..... | G10L 17/02 |
| 2021/0082439 | A1* | 3/2021 | Khoury et al. ..... | G10L 17/18 |
| 2021/0233541 | A1* | 7/2021 | Chen et al. ..... | G10L 17/02 |
| 2021/0370904 | A1* | 12/2021 | Seo et al. ..... | G06K 9/0051 |
| 2022/0028376 | A1* | 1/2022 | Wu et al. ..... | G10L 15/22 |
| 2022/0059117 | A1* | 2/2022 | Shor et al. ..... | G06N 3/088 |
| 2022/0108800 | A1* | 4/2022 | Piani Meier et al. .. | G16H 10/60 |
| 2022/0148571 | A1* | 5/2022 | Wang et al. ..... | G10L 15/063 |
| 2022/0165277 | A1* | 5/2022 | Kracun et al. ..... | G10L 15/30 |
| 2022/0189503 | A1* | 6/2022 | Blaser et al. ..... | G10L 25/81 |
| 2022/0358934 | A1* | 11/2022 | Wang et al. ..... | G10L 25/51 |

FOREIGN PATENT DOCUMENTS

| | | | |
|---|---|---|---|
| CN | 110491391 | A | 11/2019 |
| CN | 112270931 | A | 1/2021 |
| CN | 112309404 | A | 2/2021 |
| CN | 112351047 | A | 2/2021 |
| CN | 112767951 | A | 5/2021 |
| CN | 112992126 | A | 6/2021 |
| CN | 113035230 | A | 6/2021 |
| IN | 202041017652 | A | 8/2020 |

OTHER PUBLICATIONS

First Office Action issued in counterpart Chinese Patent Application No. 202110827718.8, dated Sep. 3, 2021.

Jin et al., Replay Speech Detection Based on Cepstral Features, Internet of Things Technologies, Pages 86-88, Vol. 6, dated Jun. 30, 2020.

Nasar et al., Deepfake Detection in Media Files-Audios, Images and Videos, 2020 IEEE Recent Advances in Intelligent Computational Systems (RAICS), Pages 74-79, dated Dec. 5, 2020.

Zhang et al., Speech Anti-spoofing: The State of the Art and Prospects, Journal of Data Acquisition and Processing, Pages 807-823, Vol. 35, No. 5, dated Sep. 15, 2020.

Tao et al., Development and Challenge of Speech Forgery and Detection, Journal of Cyber Security, Pages 28-38, Vol 5, No. 2, dated Mar. 15, 2020.

* cited by examiner

HIERARCHICAL GENERATED AUDIO DETECTION SYSTEM

CROSS-REFERENCE TO RELATED APPLICATIONS

The present disclosure claims priority to Chinese Patent Application 202110827718.8 entitled "Hierarchical generated audio detection system" filed on Jul. 21, 2021, the entire content of which is incorporated herein by reference.

TECHNICAL FIELD

The present disclosure relates to the field of generated audio detection, and more particularly to a hierarchical generated audio detection system.

BACKGROUND OF THE INVENTION

Considering that there is a large amount of audio files in the Internet and the number of new audio files generated in the Internet every day is measured in TB or even PB, it will be an enormous computation to accurately screen out generated audio from these data directly with a high-precision system, which is a great difficulty to consume computing resources and time.

The audio synthesized based on deep learning has been very close to the original sound in the sense of hearing, which on one hand affirms the progress of such technical means as audio synthesis and conversion; on the other hand, it also poses a great threat to information security (including criminal means of attack on audio print system and simulated sound fraud). However, due to the huge order of magnitude of real audio and generated audio in the Internet world, it will be an unprecedented computational cost to conduct detailed analysis sentence by sentence. In addition, with the development of Internet, this demand growth is likely to be exponential, thus increasing the demand for computing resources.

At present, we have not searched directly related patents in the field of generated audio detection. In the related field of audio print recognition, we have searched the method of audio print recognition by using two engines. An audio print identity authentication method, apparatus, device and storage medium based on two engines with Chinese Patent Publication No. CN112351047A relates to the field of identity recognition. The audio print identity authentication method based on two engines comprises: inputting the audio to be verified into the first audio print recognition engine to obtain the first verification score for the output; inputting the audio to be verified into the second audio print recognition engine to obtain the second verification score for the output if the first verification score is less than the first threshold and greater than the second threshold; comparing the second verification score with the third threshold, the verification is confirmed to have passed if the second verification score is greater than or equal to the third threshold. In this embodiment, the authentication is performed in combination with two engines for the audio to be verified, that is, when the first audio print recognition engine fails to pass the verification, the second audio print recognition engine will be used to obtain the second verification score for the output, and finally the second verification score is used as the basis for judging whether having passed the authentication, which improves the accuracy of the audio print recognition result.

Disadvantages of prior art: the recognition of the existing audio print recognition system is generally a one-stage model. Whether it is a single model or a multi-model integrated system, it needs to directly input the real and false audio during discrimination. Due to a high accuracy of the one-stage model, the model structure usually tends to be relatively complex which is computation-demanding; when it is directly applied to identify a large amount of audio data, it will need an intensive computation.

SUMMARY OF THE INVENTION

Considering that, the present invention provides a hierarchical generated audio detection system, which is a two-stage generated audio detection system.

Particularly, the present invention is implemented through the following technical solutions: a hierarchical generated audio detection system, comprising:

- an audio preprocessing module, a CQCC (Constant Q Cepstral Coefficients) feature extraction module, a LFCC (Linear Frequency Cepstrum Coefficients) feature extraction module, a first-stage lightweight coarse-level detection model and a second-stage fine-level deep identification model;
- performing data preprocess of collected audio or video data by the audio preprocessing module so as to obtain an audio clip with a length not exceeding the limit;
- inputting the audio clip into the CQCC feature extraction module and the LFCC feature extraction module respectively so as to obtain CQCC feature and LFCC feature of the audio clip;
- inputting the CQCC feature or LFCC feature of the audio clip into the first-stage lightweight coarse-level detection model for first-stage screening so as to screen out first-stage real audio and first-stage generated audio, wherein a second-stage audio identification need to be performed for the first-stage generated audio, but not for the first-stage real audio;
- inputting the CQCC feature or LFCC feature of the first-stage generated audio into the second-stage fine-level deep identification model so as to identify the second-stage real audio and the second-stage generated audio, wherein the second-stage generated audio is identified as generated audio.

In an embodiment of the present disclosure, the first-stage lightweight coarse-level detection model is a lightweight convolutional model, which is constructed by convolutional neural network.

In an embodiment of the present disclosure, the second-stage fine-level deep identification model adopts a single model system with higher complexity or the integration of multiple models.

In an embodiment of the present disclosure, the particular method of the data preprocessing comprises:

- normalizing the collected audio data into a monophonic audio with a sampling rate of 16 K which is stored in Wav format; and then performing mute detection on the normalized audio, extracting pure mute clip and saving the pure mute clip as an audio clip with a length not exceeding the limit;
- as to the audio from the video, firstly, using a tool to extract the audio track, and then normalizing the extracted audio data into a monophonic audio with a sampling rate of 16 K which is stored in Wav format; and then performing mute detection on the normalized audio, culling pure mute clip and saving the pure mute clip as an audio clip with a length not exceeding the limit.

In an embodiment of the present disclosure, inputs of the first-stage lightweight coarse-level detection model comprise:

LFCC feature and a splicing feature composed of a first-order difference and a second-order difference of the LFCC feature;

CQCC feature and a splicing feature composed of a first-order difference and a second-order difference of the CQCC feature;

In an embodiment of the present disclosure, inputs of the second-stage fine-level deep identification model comprise:

LFCC feature and a splicing feature composed of a first-order difference and a second-order difference of the LFCC feature;

CQCC feature and a splicing feature composed of a first-order difference and a second-order difference of the CQCC feature.

In an embodiment of the present disclosure, the specific structure of the lightweight convolution identification model includes 11 layers, including 3 layers of 2D convolutional layers, 7 layers of bottleneck residual block, and 1 layer of average pooling layer;

after average pooling layer, it is mapped to two dimensions via linear mapping, which represent real and false audio respectively. Finally, the probability that the input audio belongs to the real and false audio is obtained through softmax operation.

In an embodiment of the present disclosure, the particular method for performing the first-stage screening so as to screen out the first-stage real audio and the first-stage generated audio is as follows:

for open audio data set, computing ROC (Receiver Operating Characteristic) curve to obtain the first-stage discrimination threshold. If the first-stage lightweight coarse-level detection model identifies that the input audio is generated with a probability greater than the first-stage discrimination threshold, the input audio is deemed to be the first-stage generated audio. If the first-stage lightweight coarse-level detection model identifies that the input audio is generated with a probability less than the first-stage discrimination threshold, the input audio is deemed to be the first-stage real audio, and no secondary identification is required.

In an embodiment of the present disclosure, the particular structure of the second-stage fine-level deep identification model comprises two layers of two-dimensional convolution, one layer of linear mapping, one layer of position coding module, twelve layers of Transformer coding layer and the last output mapping layer.

In an embodiment of the present disclosure, the particular method for performing the second-stage audio identification so as to identify the second-stage real audio and the second-stage generated audio is:

for open audio data set, computing ROC curve to obtain the second-stage discrimination threshold. If the second-stage fine-level deep identification model identifies that the first-stage generated audio is generated with a probability greater than the second-stage discrimination threshold, the first-stage generated audio is deemed to be generated audio. If the second-stage deep fine-level identification module identifies that the first-stage generated audio is generated with a probability less than the second-stage discrimination threshold, the first-stage generated audio is deemed to be real audio.

Compared with prior art, the above technical solutions provided by the embodiments of the present invention have the following advantages:

first, using a lightweight model to make a preliminary screen for the collected Internet audio or the audio of other channels, and then using a single or multiple refined models to make a second-stage identification for the screened audio. The idea of hierarchical identification greatly reduces the computational cost, and even does not compromise the identification performance.

DETAILED DESCRIPTION OF THE INVENTION

Figure 1:
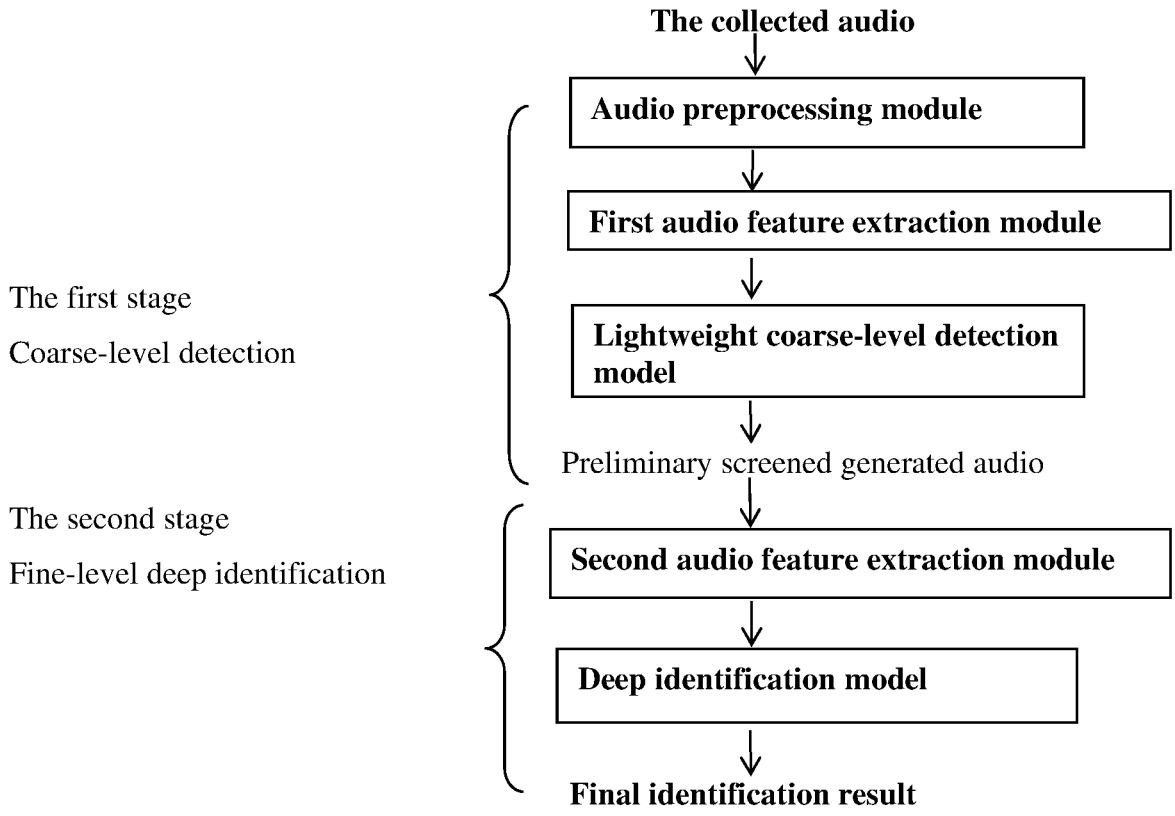
FIG. 1 is a structural block diagram of a hierarchical generated audio detection system provided in embodiments of the present invention.

Exemplary embodiments will be described here in detail, and examples thereof are shown in the accompanying drawings. When the following description refers to the drawings, unless otherwise indicated, the same numbers in different drawings indicate the same or similar elements. Implementations described in the following exemplary embodiments do not represent all implementations consistent with the present invention; on the contrary, they are merely examples of apparatus and methods consistent with some aspects of the present invention as detailed in the appended claims.

Embodiment 1

As shown in FIG. 1, a hierarchical generated audio detection system provided by the embodiments of the present disclosure comprises the following modules.

An audio preprocessing module, a first audio feature extraction module a second audio feature extraction module, a first-stage lightweight coarse-level detection model and a second-stage fine-level deep identification model; the first-stage lightweight coarse-level detection model is a lightweight convolutional model, which is typically constructed by currently widely used Mobile Net characterized by simple structure, small parameters and less computation, so it can quickly screen a large amount of data.

An embodiment of the present disclosure adopts lightweight coarse-level detection model and the whole disclosure aims at massive data. If deep model is applied to massive data for direct identification, which will cause a catastrophic-level computation. Therefore, this present disclosure uses the lightweight model with less computation for coarse-level detection, and only performs secondary identification with the fine-level deep identification model for audio that does not meet the requirements after coarse-level detection.

In some embodiments, the particular structure of the lightweight convolutional model includes 11 layers, including 3 layers of 2D convolutional layer, 7 layers of bottleneck residual block and 1 layer of average pooling layer; the size and stride of the convolution kernel of the 3 layers of 2D convolutional layer are respectively: 13 × 9 convolution core (stride 7 × 5), 9 × 7 convolution core (stride 5 × 4) and 7 × 5 convolution core (stride 4 × 1).

After average pooling layer, it is mapped to two dimensions via linear mapping, which represent real and false audio respectively. Finally, the probability that the input audio belongs to the real and false audio is obtained through softmax operation.

Generally, the output of the second-stage fine-level deep identification model still only performs real and false identification. However, under certain circumstances, multiple types of identification can also be performed for different types of generated audio or different properties of generated audio objects. Common single models include SENet, LCNN and Transformer, etc.

In some embodiments, the particular structure of the lightweight convolutional model comprises two layers of two-dimensional convolution, one layer of linear mapping, one layer of position coding module, twelve layers of Transformer coding layer and the last output mapping layer. The probability of authentication is computed through softmax function.

The audio preprocessing module preprocesses collected audio or video data to obtain an audio clip with a length not exceeding the limit, the particular methods comprise:

normalizing the collected audio data into a monophonic audio with a sampling rate of 16 K which is stored in Wav format; and then performing mute detection on the normalized audio, culling pure mute clip and saving the pure mute clip as an audio clip with a length not exceeding the limit;

as to the audio from video, firstly, using a tool to extract the audio track, and then normalizing the extracted audio data into a monophonic audio with a sampling rate of 16 K which is stored in Wav format; and then performing mute detection on the normalized audio, culling pure mute clip and saving the pure mute clip as an audio clip with a length not exceeding the limit.

In some embodiments, the first audio feature extraction module is a CQCC feature extraction module or an LFCC feature extraction module.

In some embodiments, the second audio feature extraction module is a CQCC feature extraction module or an LFCC feature extraction module.

The methods may further comprise: inputting the audio clip into the CQCC feature extraction module and the LFCC feature extraction module respectively to obtain CQCC feature and LFCC feature.

The input of the first-stage lightweight coarse-level detection mode further comprises:

inputting the LFCC feature and the splicing feature composed of the first-order difference and the second-order difference of the LFCC feature, or the CQCC feature and the splicing feature composed of the first-order difference and the second-order difference of the CQCC feature, into the first-stage lightweight coarse-level detection model for the first-stage screening to screen out the first-stage real audio and the first-stage generated audio, the particular method thereof is as follows: for open audio data set, computing ROC curve to get a first-stage discrimination threshold such as 0.5, if the first-stage lightweight coarse-level detection model identifies that the input audio is generated with a probability greater than the first-stage discrimination threshold, the input audio is deemed to be the first-stage generated audio. If the first-stage lightweight coarse-level detection model identifies that the input audio is generated with a probability less than the first-stage discrimination threshold, the input audio is deemed to be the first-stage real audio, and no second-stage identification is required for the first-stage real audio but the first-stage generated audio needs a second-stage identification;

inputting the LFCC feature of the first-stage generated audio and the splicing feature composed of the first-order difference and the second-order difference of the LFCC feature, or the CQCC feature and the splicing feature composed of the first-order difference and the second-order difference of the CQCC feature, into the second-stage fine-level deep identification model to screen out the second-stage real audio and the second-stage generated audio, the second-stage generated audio is identified as generated audio, the particular method thereof is as follows: for open audio data set, computing ROC curve to obtain a second-stage discrimination threshold, if the second-stage fine-level deep identification model identifies that the first-stage generated audio is real with a probability greater than the second-stage discrimination threshold, the first-stage generated audio is deemed to be generated audio, if the second-stage fine-level deep identification model identifies that the first-stage generated audio is generated with a probability less than the second-stage discrimination threshold, the first-stage generated audio is deemed to be real audio.

Embodiment 2

The first-stage lightweight coarse-level detection model is constructed by MobileMetV2 with its model structure having 11 layers, including 3 layers of 2D convolutional layer, 7 layers of bottleneck residual block and 1 layer of average pooling layer. The parameter of the model is about 5 M. The first-stage lightweight coarse-level detection model uses LFCC feature and the splicing feature composed of the first-order and second-order differences (60 dimensions in total) of the LFCC feature as input; inputting a clip with the audio pseudo length of 20 seconds (fill with 0 if less than 20 seconds and truncate if more than 20 seconds). The model input contains only one channel while the output contains two nodes, representing the real and false respectively.

The second-stage fine-level deep identification model is constructed by Transformer model. From the bottom layer to the top layer, the fine-level deep identification model includes two layers of two-dimensional convolutional layer, one layer of linear mapping, one layer of position coding module, twelve layers of Transformer coding layer and the last output mapping layer. The overall parameter of the model is about 20 M, wherein, the convolutional layer is set with a stride of 2, so it is equivalent to 4 times sequential downsampling through the convolutional layer. The fine-level deep identification model uses LFCC feature and the splicing feature composed of the first-order and second-order differences (60 dimensions in total) of the LFCC feature as input. The output of the last output mapping layer is of two types, indicating the real and false respectively.

The model is divided into two stages during identification progress. In the first stage, the lightweight convolution model is used to roughly identify massive audio, the audio with generation probability less than 0.5 is directly skipped, and the audio with generation probability greater than 0.5 has a secondary identification with fine-level deep identification model. For the audio undergoing a secondary identification, the secondary identification result will be final identification result.

Embodiment 3

The generated audio has diverse types, typically including playback, neural synthesis, splicing and so on. In view of the classification identification of massive data, the audio detection system is generated by using hierarchical and multi-classification big data.

The first-stage lightweight coarse-level detection model is constructed by MobileMetV2 with its model structure having 11 layers, including 3 layers of 2D convolutional layer, 7 layers of bottleneck residual block and 1 layer of average pooling layer. The parameter of the model is about 5 M. The first-stage lightweight coarse-level detection model uses LFCC feature and the splicing feature composed of the first-order and second-order differences (60 dimensions in total) of the LFCC feature as input; inputting a clip with the audio pseudo length of 20 seconds (fill with 0 if less than 20 seconds and truncate if more than 20 seconds). The model input contains only one channel while the output contains two nodes, indicating the real and false respectively.

The second-stage fine-level deep identification model is constructed by Transformer model. From the bottom layer to the top layer, the fine-level deep identification model includes two layers of two-dimensional convolutional layer, one layer of linear mapping, one layer of position coding module, twelve layers of Transformer coding layer and the last output mapping layer. The overall parameter of the model is about 20 M, wherein, the convolutional layer is set with a stride of 2, so it is equivalent to 4 times sequential downsampling through the convolutional layer. The fine-level deep identification model uses LFCC feature and the splicing feature composed of the first-order and second-order differences (60 dimensions in total) of the LFCC feature as input. The output of the last output mapping layer is of four types, indicating real audio, replay, splicing and neural synthesis respectively.

The model is divided into two stages during identification progress. In the first stage, the lightweight model is used to roughly identify massive audio, the audio identified with a generation probability less than 0.5 is directly skipped, and the audio with generation probability greater than 0.5 has a secondary identification with fine-level deep identification model. In the process of secondary identification, the authenticity and generation type of the model are identified simultaneously.

The terms used in this present invention are intended solely to describe particular embodiments and are not intended to limit the invention. The singular forms "one", "the" and "this" used in the present invention and the appended claims are also intended to include the plural forms, unless the context clearly indicates otherwise. It should also be understood that the terms "and/or" used herein refer to and include any or all possible combinations of one or more associated listed items.

It should be understood that although the terms first, second, third, etc. may be used to describe information in the present invention, such information should not be limited to those terms. Those terms are only used to distinguish the same type of information from one another. For example, without departing from the scope of the present invention, the first information may also be referred to as the second information, and similarly vice versa. Depending on the context, the word "if" as used herein can be interpreted as "while" or "when" or "in response to certain cases".

Embodiments of the disclosed subject matter and functional operations described in this specification may be implemented in digital electronic circuits, tangible computer software or firmware, computer hardware including the structures disclosed in this specification and their structural equivalents, or a combination of one or more of them. Embodiments of the subject matter described herein may be implemented as one or more computer programs, that is, one or more modules of computer program instructions encoded on a tangible non-transitory program carrier to be executed by the data processing device or to control the operation of the data processing device. Alternatively or additionally, program instructions may be encoded on manually generated propagation signals, such as electrical, optical or electromagnetic signals generated by machine, which are generated to encode and transmit information to a suitable receiver for execution by the data processing device. The computer storage medium may be a machine-readable storage device, a machine-readable storage substrate, a random or serial access memory device, or a combination of one or more of them.

The processing and logic flow described herein can be executed by one or more programmable computers executing one or more computer programs to perform corresponding functions by operating according to input data and generating output. The processing and logic flow can also be executed by an application specific logic circuit, such as FPGA (field programmable gate array) or ASIC (application specific integrated circuit), and the apparatus can also be implemented as an application specific logic circuit.

Computers suitable for executing computer programs comprise, for example, general-purpose and/or special-purpose microprocessors, or any other type of central processing unit. Generally, the central processing unit receives instructions and data from read-only memory and/or random access memory. The basic components of a computer comprise a central processing unit for implementing or executing instructions and one or more memory devices for storing instructions and data. Generally, the computer further comprises one or more mass storage devices for storing data, such as magnetic disk, magneto-optical disk or optical disk, or the computer is operatively coupled with the mass storage device to receive data from or transmit data to it, or both. However, this device is not a necessity for a computer. Additionally, the computer may be embedded in another device, such as a mobile phone, a personal digital assistant (PDA), a mobile audio or video player, a game console, a global positioning system (GPS) receiver, or a portable storage device such as a universal serial bus (USB) flash drive, just to name a few.

Computer readable media suitable for storing computer program instructions and data include all forms of nonvolatile memory, media and memory devices, for example, semiconductor memory devices (such as EPROM, EEPROM and flash memory devices), magnetic disks (such as internal HDD or removable disks), magneto-optical disks, and CD-ROM and DVD-ROM disks. The processor and memory may be supplemented by or incorporated into an application specific logic circuit.

Although this specification contains many particular embodiments, these should not be construed to limit the scope of any invention or the scope of protection claimed, but are intended primarily to describe the characteristics of specific embodiments of a particular invention. Some of the features described in multiple embodiments in this specification may also be implemented in combination in a single embodiment. On the other hand, features described in a single embodiment may also be implemented separately in multiple embodiments or in any suitable subcombination. In addition, although features may function in certain combinations as described above and even initially claimed as such, one or more features from the claimed combination may in some cases be removed from the combination, and the claimed combination can be directed to a sub-combination or a variant of the sub-combination.

Similarly, although operations are described in a particular order in the drawings, this should not be construed as requiring these operations to be performed in the particular order or sequence as shown, or requiring all illustrated operations to be performed to achieve the desired results. In some cases, multitasking and parallel processing may be advantageous. In addition, the separation of various system modules and components in the above embodiments should not be construed as requiring such separation in all embodiments, and it should be understood that the described program components and systems can generally be integrated together in a single software product or encapsulated into multiple software products.

Thus, specific embodiments of the subject matter have been described. Other embodiments are within the scope of the appended claims. In some cases, the actions described in the claims can be executed in different orders and still achieve the desired results. In addition, the processes described in the drawings do not have to be in the particular order or sequential order as shown to achieve the desired results. In some implementations, multitasking and parallel processing may be advantageous.

The description above are only the preferred embodiments of the present invention and are not intended to limit the present invention. Any modification, equivalent replacement, improvement, etc. made within the spirit and principle of the present invention shall be included in the scope of protection of the invention.

The invention claimed is:

1. A hierarchical generated audio detection system, wherein the hierarchical generated audio detection system is a two-stage generated audio detection system, the system comprising:

an audio preprocessing module;

a CQCC (Constant Q Cepstral Coefficients) feature extraction module; and an LFCC (Linear Frequency Cepstrum Coefficients) feature extraction module, wherein the hierarchical generated audio detection system includes a first-stage lightweight coarse-level detection model and a second-stage fine- level deep identification model, and wherein performing a generated audio detection by the hierarchical generated audio detection system comprises:

performing data preprocess of collected audio or video data by the audio preprocessing module so as to obtain an audio clip with a length not exceeding a predetermined limit;

inputting the audio clip into the CQCC feature extraction module and the LFCC feature extraction module respectively so as to obtain CQCC feature and LFCC feature;

inputting the CQCC feature or LFCC feature into the first-stage lightweight coarse-level detection model for first-stage screening so as to screen out a first-stage real audio and a first-stage generated audio, inputting the first-stage generated audio into the CQCC feature extraction module and the LFCC feature extraction module respectively so to obtain CQCC feature and LFCC feature of the first-stage generated audio;

inputting the CQCC feature or LFCC feature of the first-stage generated audio into the second-stage fine-level deep identification model so as to identify a second-stage real audio and a second-stage generated audio, wherein the second-stage generated audio is identified as a generated audio;

wherein the first-stage lightweight coarse-level detection model is a lightweight convolutional model, which is constructed by convolutional neural network; and wherein the second-stage fine-level deep identification model adopts a single model system with a higher complexity or the integration of multiple models;

wherein a particular structure of the lightweight convolution model includes 11 layers, including 3 layers of 2D convolutional layers, 7 layers of bottleneck residual block, and 1 layer of average pooling layer;

wherein a CQCC feature or an LFCC feature after the average pooling layer is mapped, via linear mapping, to two dimensions which present real and generated audio respectively;

wherein the probability that the audio clip inputted belongs to the real and generated audio is obtained through softmax operation; and wherein a particular method for performing the first-stage screening so as to screen out the first-stage real audio and the first-stage generated audio is as follows:

for an open audio data set, computing ROC (Receiver Operating Characteristic) curve to obtain the first-stage discrimination threshold, if the first-stage lightweight coarse-level detection model identifies that a probability of the input audio being the first-stage generated audio is greater than the first-stage discrimination threshold, the input audio is deemed to be the first-stage generated audio, if the first-stage lightweight coarse-level detection model identifies that a probability of the input audio being the first-stage generated audio is less than the first- stage discrimination threshold, the input audio is deemed to be the first-stage real audio, and no secondary identification is required, and wherein generated audio is spoofed audio.

2. The hierarchical generated audio detection system according to claim 1, wherein inputs of the first-stage lightweight coarse-level detection model comprise:

LFCC feature and a splicing feature composed of a first-order difference and a second-order difference of the LFCC feature; and CQCC feature and a splicing feature composed of a first-order difference and a second-order difference of the CQCC feature.

3. The hierarchical generated audio detection system according to claim 1, wherein inputs of the second-stage fine-level deep identification model comprise:

LFCC feature and a splicing feature composed of a first-order difference and a second-order difference of the LFCC feature; and CQCC feature and a splicing feature composed of a first-order difference and a second-order difference of the CQCC feature.

4. The hierarchical generated audio detection system according to claim 1, wherein a particular structure of the second-stage fine-level deep identification model comprises two layers of two-dimensional convolution, one layer of linear mapping, one layer of position coding module, twelve layers of transformer coding layer and the last output mapping layer.

5. The hierarchical generated audio detection system according to claim 4, wherein a particular method for identifying the second-stage real audio and the second-stage generated audio is as follows:

for open audio data set, computing ROC curve to obtain the second-stage discrimination threshold, if the second-stage deep fine-level identification module identifies that the first-stage generated audio is generated with a probability greater than the second-stage discrimination threshold, the first-stage generated audio is deemed to be generated audio, and if the second-stage fine-level deep identification model identifies that the first-stage light-weight coarse-level detection model is generated with a probability less than the second-stage discrimination threshold, the first-stage generated audio is deemed to be real audio.

* * * * *